United States Patent [19]

Achelpohl

[11] 4,007,669

[45] Feb. 15, 1977

[54] APPARATUS FOR REVERSING THE RUNNING DIRECTION OF TUBE SECTIONS IN SACK MACHINES

[75] Inventor: Fritz Achelpohl, Lengerich, Germany

[73] Assignee: Windmoller & Holscher, Germany

[22] Filed: July 2, 1975

[21] Appl. No.: 592,668

[30] Foreign Application Priority Data

July 4, 1974 Germany ..... 7422818

[52] U.S. Cl. ..... 93/8 R; 271/225; 271/DIG. 9

[51] Int. Cl.[2] ..... B65H 5/00

[58] Field of Search ..... 271/DIG. 9, 184, 186, 271/225; 93/8 R, 32, 27

[56] References Cited

UNITED STATES PATENTS 3,841,622 10/1974 Swanson ..... 271/225 X
3,856,295 12/1974 Looney ..... 271/225 X
3,871,270 3/1975 Kuckhermann et al. ..... 93/8 R X

OTHER PUBLICATIONS

Harding, S. R., "Sheet Turnover Device", IBM Technical Disclosure Bulletin, vol. 18, No. 1, June, 1975.

*Primary Examiner*—James F. Coan
*Attorney, Agent, or Firm*—Fleit & Jacobson

[57] ABSTRACT

Apparatus for reversing the running direction of a tube section in a machine for making sacks or bags comprises a turning cylinder with grippers for engaging the tube sections and pairs of rollers for conveying the tube sections in the opposite direction. At least one roller of the pair is movable and provided with a control effective to bring the rollers together with a snap action and separating them again after the tube sections have been transferred to a feed conveyor.

11 Claims, 3 Drawing Figures

APPARATUS FOR REVERSING THE RUNNING DIRECTION OF TUBE SECTIONS IN SACK MACHINES

Figures 1, 3:
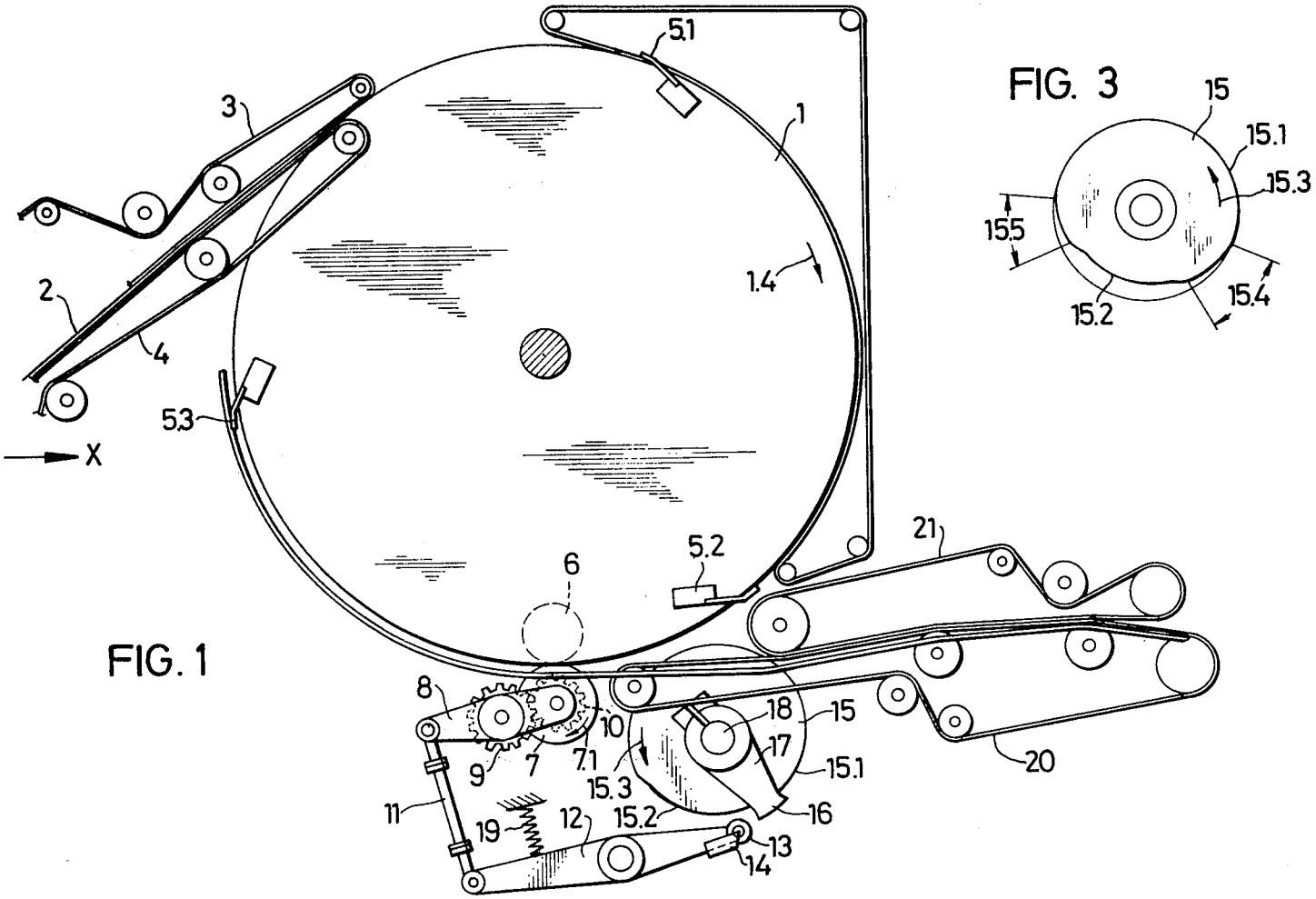

The invention relates to an apparatus for reversing the running direction of a tube section in a machine for making sacks or bags which are closed by a base at both ends, particularly sacks or bags of plastics film, comprising a turning cylinder provided with grippers engaging the tube sections and with pairs of rollers conveying same in the opposite direction.

In an apparatus of this kind known from German Specification No. 539,221, the tube sections pass through the machine in the longitudinal direction and the bases are each made on two similar prefolding and folding cylinders. Between these groups of folding cylinders there is a turning cylinder on which the tube sections are turned, so that the originally trailing end of the tube section is leading when fed to the second group of base-folding cylinders. The turning cylinder runs in the direction of the arriving tube sections and engages the leading base portion that has just been finished and carries it along through about three quarters of a revolution. Thereafter the rear end of the tube section is engaged at the right hand and left hand margin by two pairs of rollers turning in the opposite direction, one roller comprising a pressure cam formed by a roller segment of larger radius. Simultaneously, the grippers release the tube section which is now fed in the opposite direction with the open tube end foremost to the next group of base-folding cylinders.

The known apparatus has the disadvantage that the relatively slow cams turning at the same speed as the tube sections often do not engage the tube section simultaneously, so that it is carried along firstly by the one and then by the other cam and thus brought into an oblique position with respect to the conveying direction. There is therefore the danger that the next group of base-folding cylinders will fold the base obliquely to the tube section, thereby creating faulty workpieces that have to be eliminated and occasioning blockages which require the machine to be shut down.

The invention aims to provide an apparatus which more reliably engages the trailing end of the tube section in the correct position so that the tube section can, after reversing its feeding direction, be transferred to the following processing cylinder parallel to the feed direction.

According to the invention, an apparatus of the aforementioned kind is characterised in that at least one roller of the pair of rollers is movable and provided with a control which suddenly moves the rollers together to grip the tube sections and, after transferring them to a feed conveyor, separates them again. By means of the construction according to the invention, the tube sections are simultaneously engaged by both pairs of rollers, thereby ensuring a position parallel to their feeding direction and enabling clean folding of the second bases to be formed.

For the sudden approach of the rollers there is preferably provided a pawl and ratchet device which is actuated by a control and releases the roller subjected to a prestressed spring after a pawl has run off a ratchet.

Preferably the one rollers of the pair are mounted on first levers pivotable in the frame and connected to at least one further lever with which the accelerating spring for the rollers engages. This ensures that the rollers are forcefully brought together.

Preferably, a roller is rotatably mounted on the second free lever arm and it runs on a cam plate. This makes movement of the levers controllable.

In order to interrupt the movement of the rollers for a short time, the second free lever arm comprises a pawl which rests on a ratchet cam that is retractable by rotation of the cam plate.

To enable the rollers of the pairs of rollers to approach one another before engagement of the tube section, the cam plate comprises an upper land, a lower land and transistion curves, and the second lever is lowerable by a first transition curve from the upper land to a lower land height.

In one form of the invention, the second lever can be returned by the second transition curve of a cam to the starting position defined by the upper land of the cam. This achieves return to the starting position in a simple manner.

To ensure reliable transfer of the tube section and to avoid damage, the corresponding grippers are opened on unlatching of the pawl and ratchet cam which form a so-called tear-off cam.

The turning cylinder preferably comprises a fixed inner portion and rotary outer portions.

In order that the rollers cannot exert a marked moment on the tube section even if they were to engage the tube section unevenly despite the use of the tear-off cam in accordance with the invention, the other rollers of each pair are rotatably mounted on the fixed portion of the turning cylinder and fixed to a common shaft. This feature desirably supports the construction of the apparatus according to the invention to ensure that the workpieces are led away in the parallel direction.

Figure 2:
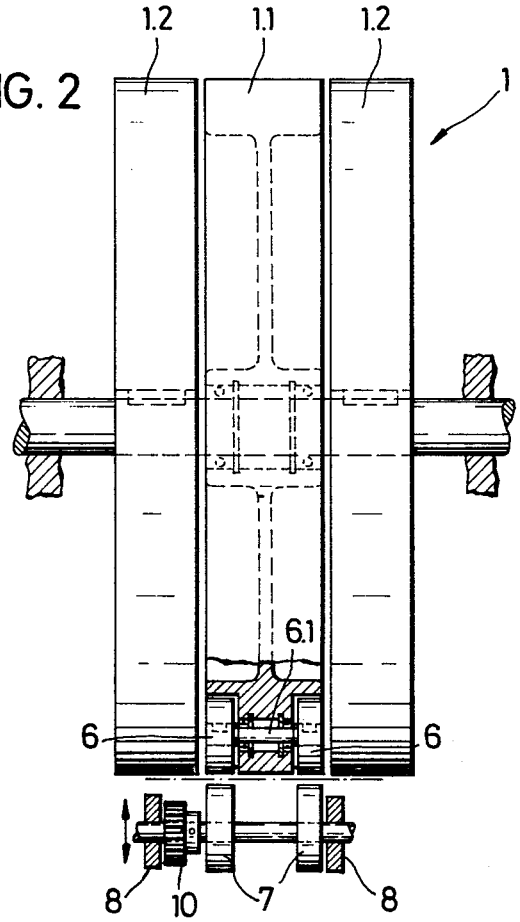

An example of the invention will now be described in more detail with reference to the drawing in which:

FIG. 1 is an end elevation;

FIG. 2 a view of the apparatus in the direction X, and

FIG. 3 is a detailed view of the cam plate.

A turning cylinder 1 of a machine for making a bag or sack closed at both ends by a base is supplied with a tube section 2 by belt guides 3 and 4, the leading end of the tube section having just had a base formed on it by an upstream processing cylinder. The turning cylinder 1 consists of a fixed central portion 1.1 on which the tube sections slide and two outer portions 1.2 which turn in the direction of the arrow 1.4 and are provided at their periphery with three grippers 5.1, 5.2, 5.3 which engage and hold the arriving tube sections 2 successively. Rollers 6 are fixed to a shaft 6.1 rotatably mounted in the central portion 1.1 of the turning cylinder 1. Opposite these there are rollers 7 which are rotatably mounted on first levers 8 and driven by gears 9 and 10 in the direction of the arrow 7.1. The first levers 8 are hingedly connected by a coupling 11 to one end of a second lever 12. The other end of the lever 12 is provided with a roller 13 and a pawl 14. The roller 13 is in contact with a cam plate 15 having an upper land 15.1 and a lower land 15.2. The cam 15 turns in the direction of the arrow 15.3 at one third of the rotary speed of the turning cylinder 1 or its outer portions 1.2. Fixed to a shaft 18 driving the cam plate 15 there is a lever 17 provided with a ratchet cam 16. The ratchet cam 16 has a surface concentric with the shaft 18. Together with the pawl 14 it forms a so-called tear-off cam. Transition curves 15.4 and 15.5 are provided on the cam 15 between the upper land 15.1 and the lower land 15.2 for flattening off the height of the land 15.1 to the height of the land 15.2. The lever 17 is adjusted so that it or the ratchet cam 16 lies between the transition curve 15.4 and the lower land 15.2. On rotation of the cam 15 the roller 13 of the lever 12 rolls on the upper land 15.1 against which it lies under the action of a spring 19. The spring 19 is stressed between the lever 12 and the frame (not shown) of the machine. It is lowered to the somewhat lower slide block 16 by the cam portion 15.4. This disengages the roller 13 from the cam 15. When the pawl 14 leaves the ratchet cam 16, the turning rollers 7 are pressed against the rollers 6 by the levers 8 and 12 as well as the coupling 11 and the action of the spring 19. At the angular path between where the pawl 14 jumps off the ratchet cam 16 and the transition curve 15.5, the roller 13 continues to be disengaged from the cam 15 or its lower land 15.2. It only runs onto the second transition curve 15.5 by which it is lifted to the upper land 15.1.

Under the action of the rotating turning rollers 7 pressed against the rollers 6, the end of the tube section 2 that is being fed by the turning cylinder 1 and that is located between the rollers 6 and 7 is engaged by the rollers 6, 7. At the same time the grippers 5.3 are opened and the tube section is moved in the opposite direction and transferred to the next processing station for example by belt guides 20, 21. Since jumping off of the pawl 14 from the ratchet cam 16 takes place with a snap action by reason of the very strong dimensioning of the spring 19, the workpiece will be engaged in the position in which it arrives, so that faulty folding of the second base caused by oblique positioning of the tube section is avoided. As the workpiece held by the gripper 5.3 enters the position shown in FIG. 1, the base of the tube section is passed between the rollers 6, 7. At the same time the preceding workpiece fed by the belts 20, 21 leaves the gap between the rollers 6, 7. The cam 15 or its upper land 15.1 must be so dimensioned that the two workpieces can pass one another without difficulty. For this reason the elevation of the land 15.1 is appropriately high. However, to prevent the rollers 7 from striking the rollers 6 from such a large distance, which would lead to intensive loading of the machine and, as described later, would cause considerable displacement of the phase position of the tube section at different speeds of the machine, the transition curve 15.4 is provided through which the rollers 7 are brought closer to the rollers 6, so that only a small gap remains between the two rollers just before reversal of the direction of movement of the tube section. The rollers 6 are fixed to the shaft 6.1. Even if the tube section were to be engaged by one pair of rollers 6, 7 before the other pair, despite the use of the tear-off cam 14, 16 in accordance with the invention, the roller 6 of the other pair would be driven by the common shaft 6.1 so that, with the small roller gap that is provided, the tube section would be carried along in the desired reverse direction as a result of friction between the roller 6 of the other pair and the tube section, and an oblique position caused by one-sided engagement is avoided. The narrow roller gap achieves a short switching period which becomes particularly noticeable and is advantageous with the differences that occur in the operating speed of the sack machine, because the grippers 5 are controlled by rigid mechanical control elements but the control of the rollers 7 exhibits a dynamic behaviour. This is because the rollers 7 at high operating speeds of the machine strike the rollers 6 only after a larger rotary angle of the turning cylinder 1 than they do at a lower operating speed. For this reason, depending on the angular setting of the lever 17 and the speed of the machine, it can happen that the rollers 6, 7 engage the tube section when the gripper 5.3 is still closed so that the tube section is torn out of the hold of the gripper and possibly damaged, or the grippers 5.3 are already open when the rollers 7 have not yet reached the rollers 6 or the tube section lying thereon. The tube section is then loose and can change its position. These differences in rotary angle and the difficulties resulting therefrom as just described are kept to a minimum by the smallest possible roller gaps prior to unlatching of the tear-off cam.

I claim:

1. Apparatus for reversing the running direction of a tube section in a machine for making sacks or bags which are closed by a base at both ends particularly sacks or bags of plastics film, comprising a turning cylinder provided with grippers for engaging the tube sections and a pair of rollers for conveying the tube sections in a direction opposite to said running direction, at least one roller of said pair being movable, and a control for suddenly moving said pair of rollers together to grip the tube sections and to separate the pair of rollers again after transferring the tube sections to an associated feed conveyor.

2. Apparatus according to claim 1 including a pawl and ratchet device for the sudden movement of said pair of rollers together which is actuated by said control, a prestressed spring operatively associated with said pawl and ratchet device, said spring being arranged to actuate the separation of said pair or rollers after said pawl has run off said ratchet.

3. Apparatus according to claim 2, including a frame, a first lever pivotally mounted on said frame, at least one second lever connected to said first lever and engagable by said spring and wherein said one roller of said pair is mounted on said first lever.

4. Apparatus according to claim 3, wherein said second lever is in the form of a two-armed lever having a free lever arm, a cam plate and a roller which runs on said cam plate rotatably mounted on said free lever arm.

5. Apparatus according to claim 3, including a ratchet cam and wherein said free lever arm is provided with a pawl which rests on said ratchet cam, said ratchet cam being retractable by rotation of said cam plate.

6. Apparatus according to claim 4, wherein said cam plate comprises an upper land, a lower land, and a plurality of transistion curves.

7. Apparatus according to claim 6, wherein said second lever is lowerable by the first transition curve from the upper land to a lower land height.

8. Apparatus accordingly to claim 7, wherein said second lever is returnable by the second transition curve of said cam plate to a starting position defined by the upper land of said cam plate.

9. Apparatus according to claim 2 wherein said grippers are opened upon unlatching of the tear-off cam formed by said pawl and ratchet device.

10. Apparatus according to claim 1 wherein said turning cylinder includes a fixed inner portion and rotary outer portions.

11. Apparatus according to claim 10 including a shaft mounted on said turning cylinder fixed inner portion and wherein the other roller of said pair of rollers is fixed to said shaft for rotation on said fixed portion.

* * * * *